US008128217B2

(12) United States Patent
Adams et al.

(10) Patent No.: US 8,128,217 B2
(45) Date of Patent: Mar. 6, 2012

(54) MATERIAL CUTTER WITH A SELECTABLE CUTTING PROFILE

(75) Inventors: Michael Scott Adams, Suwanee, GA (US); Marc R. Obenshain, Cumming, GA (US)

(73) Assignee: Panduit Corp., Tinley Park, IL (US)

( * ) Notice: Subject to any disclaimer, the term of this patent is extended or adjusted under 35 U.S.C. 154(b) by 19 days.

(21) Appl. No.: 12/578,074

(22) Filed: Oct. 13, 2009

(65) Prior Publication Data

US 2010/0018376 A1 Jan. 28, 2010

Related U.S. Application Data

(63) Continuation of application No. 11/290,912, filed on Nov. 30, 2005, now Pat. No. 7,632,031.

(60) Provisional application No. 60/631,953, filed on Nov. 30, 2004.

(51) Int. Cl.
*B41J 2/01* (2006.01)
*B41J 15/18* (2006.01)

(52) U.S. Cl. ..... 347/104; 400/621; 400/613

(58) Field of Classification Search ..... 347/104, 347/101, 108, 109; 400/613, 621; 83/697, 83/693

See application file for complete search history.

(56) References Cited

U.S. PATENT DOCUMENTS

| | | | | |
|---|---|---|---|---|
| 5,209,151 | A | 5/1993 | Takagi et al. | |
| 5,235,887 | A * | 8/1993 | Moriya | 83/282 |
| 5,676,478 | A | 10/1997 | Bowman et al. | |
| 6,109,154 | A * | 8/2000 | Miyatsu et al. | 83/697 |
| 6,705,784 | B2 | 3/2004 | Furuya et al. | |
| 6,732,619 | B2 | 5/2004 | Carriere et al. | |
| 6,997,095 | B1 | 2/2006 | Kishi et al. | |
| 7,059,793 | B2 | 6/2006 | Mori et al. | |
| 7,114,866 | B2 | 10/2006 | Ueno et al. | |
| 2003/0198499 | A1 | 10/2003 | Tsuchiya et al. | |
| 2005/0061132 | A1 | 3/2005 | Sodeyama | |
| 2005/0147453 | A1 | 7/2005 | Ueno et al. | |
| 2006/0104701 | A1 | 5/2006 | Myers | |
| 2006/0133882 | A1 | 6/2006 | Adams et al. | |

FOREIGN PATENT DOCUMENTS

| | | |
|---|---|---|
| EP | 0798254 A2 | 10/1997 |
| JP | 08011371 | 1/1996 |
| JP | 10029192 | 2/1998 |
| JP | 10249788 | 9/1998 |
| JP | 2000052292 | 2/2000 |

* cited by examiner

*Primary Examiner* — Manish S Shah

(74) *Attorney, Agent, or Firm* — Robert A. McCann; Christopher S. Clancy

(57) ABSTRACT

A material cutter for producing a selected cutting profile. The material cutter includes a cutter frame and a cutter button. The cutter frame has a stationary blade. The cutter button, which is slidably mounted in the cutter frame, has a moving blade with a cutting edge. The cutter button preferably includes a profile selector, so that when a driving force is applied to the cutter button, the moving blade slides past the stationary blade to the extent allowed by the profile selector. The profile selector may be a knob and the cutting profile may be set manually or automatically. It is preferred that at least one of the selectable cutting profiles is a partial cut.

7 Claims, 7 Drawing Sheets

MATERIAL CUTTER WITH A SELECTABLE CUTTING PROFILE

CROSS REFERENCE TO RELATED APPLICATIONS

This application is a continuation of U.S. patent application Ser. No. 11/290,912, filed Nov. 30, 2005, which claims the benefit of U.S. Provisional Application No. 60/631,953 filed Nov. 30, 2004, and is incorporated herein by reference in its entirety.

FIELD OF THE INVENTION

The present invention relates generally to material cutters, and more particularly, to a material cutter with a selectable cutting profile. The material cutter may, for example, be adapted for use with a label printer to apply a selected cutting profile to a series of labels exiting the printer.

BACKGROUND

Printing machines, or printers, are often used to produce labels bearing legends, graphics, text, such as instructions or warnings, etc. A variety of printers may be used for this application, ranging for example from large industrial printers, to commonplace desktop printers, such as laser, thermal transfer, inkjet or dot matrix printers, to portable or hand-held printers, such as a hand-held thermal transfer label printer. Printers may print information on a variety of different materials, e.g., label rolls, label sheets, photographic paper, etc. For many labeling applications, printers print labels on continuous label media or a series of individual labels carried on a continuous liner or carrier. For example, the label media may be a roll of pressure sensitive tape that is attached by an adhesive to a liner. The printer may then print a series of legends along the tape, and the individual labels are formed by cutting through the tape and liner between each pair of legends to separate each individual label from the roll. The liner would then typically be removed so that the label can be applied to its desired location.

In many instances, where a series of labels are printed, a logical relationship exists among the labels. For example, the printer may produce all of the labels required to sequentially label the wires in an electrical cabinet. In this type of application, the user may struggle to keep individual labels organized so that the labeling task can be completed accurately and efficiently, particularly as the complexity of the labeling task increases. On the other hand, if the label media is not cut into individual labels, the user will need to manually and precisely cut each individual label from the label media, adding time and potentially introducing errors. Thus, an improved material cutter is needed.

SUMMARY OF THE INVENTION

An improved material cutter is disclosed for cutting media, such as label media. According to an exemplary embodiment, the material cutter is incorporated into a hand-held printing apparatus. In the exemplary embodiment, the material cutter may be used to cut printed label media. The material cutter includes an apparatus for selecting between two cutting profiles: full cut mode and partial cut mode. In full cut mode, the material cutter cuts completely through the media. In partial cut mode, however, the material cutter only cuts partially through the media—thus, leaving an attachment point that can be separated at a later time.

In the embodiment, the material cutter includes a cutter button that fits within a cutter frame. The cutter button includes a moving blade and a profile selector. When a driving force is applied to the cutter button, the moving blade is forced across a stationary blade of the cutter frame. As the moving blade slides past the stationary blade, any media resting between is cut. The driving force on the cutter button is preferably a manual force applied by a user.

The profile selector may include a manually rotatable selector knob attached to an asymmetric retainer plate that is configured to rotate with the selector knob. When the retainer plate is in partial cut mode, two bosses restrict the movement of the cutter button and thus the moving blade. When the retainer plate is in full-cut mode, the cutter button is free to force the moving blade fully past the stationary blade. In operation, a post/slot configuration restricts the turn span of the knob and a series of nub-holes provide stop points for the knob. Two such stop points may correspond to the full cut mode and partial cut mode.

The summary describes a limited overview of an embodiment of the present invention. These and other aspects and advantages will become apparent to those of ordinary skill in the art by reading the following detailed description, with reference where appropriate to the accompanying drawings. Further, it should be understood that the foregoing summary is merely exemplary and is not intended to limit the scope of the invention as claimed.

DETAILED DESCRIPTION OF THE PRESENTLY PREFERRED EMBODIMENTS

I. Overview

In accordance with one embodiment, a material cutter is provided having at least two cutting profiles that may be selected by a user. A first cutting profile produces a partial cut, while a second cutting profile produces a full cut. During operation in partial cut mode, the material cutter cuts through a first portion of a label material or liner material, but leaves a second portion of the material uncut. In a preferred embodiment, the partial cut mode allows a series of printed labels to remain linked after being printed and partially cut. Individual labels may be readily separated from the series at a later time without damaging the labels. In full cut mode, the material cutter cuts completely though the label material (or liner material) to produce individual labels.

The material cutter may be incorporated into a variety of printers. In the preferred embodiment, the material cutter is incorporated into a hand-held thermal transfer printer. In this embodiment, the material cutter has a selectable cutting profile and cuts the label material or the liner material after the material has passed the thermal transfer print head. For instance, the material cutter may cut the material as the material exits a printer housing.

II. Material Cutter

Figure 1:
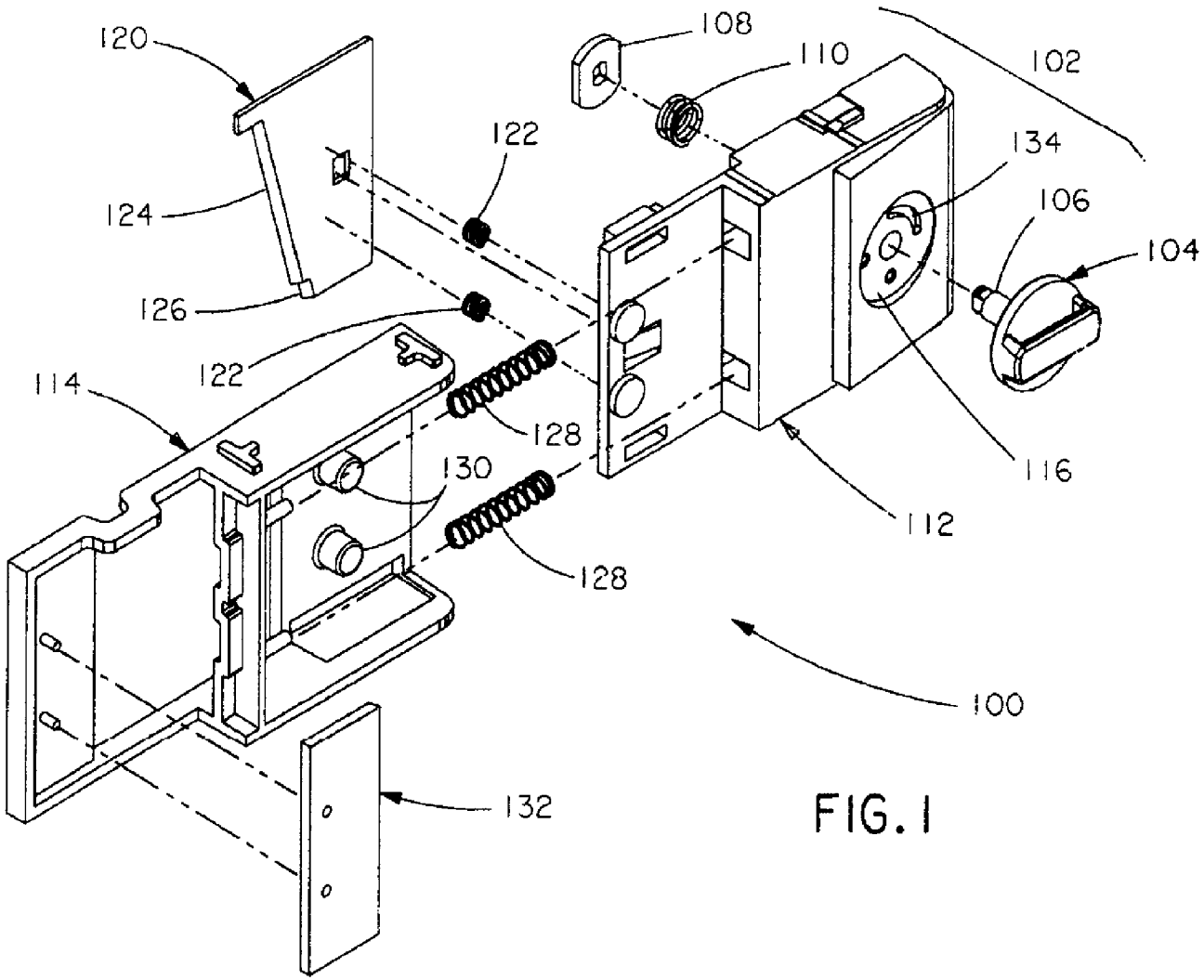
FIG. 1 is an exploded perspective view of a material cutter, including a cutting profile selector.

FIG. 1 is an exploded perspective view of a material cutter 100, including a cutting profile selector 102. In this embodiment, the cutting profile selector 102 is a selector knob 104 having an axial projection 106 that is attached, at its distal end, to an asymmetric retainer plate 108. A spring 110 is disposed about the axial projection 106, between the retainer plate 108 and the selector knob 104.

The material cutter 100 includes a cutter button 112 and a cutter frame 114. The cutter button 112 has a recess 116 with an aperture 614 for receiving the axial projection 106 of the selector knob 104. The recess 116 includes a curved slot 134 for defining a maximum rotation pattern for the knob 104. The recess 116 also includes a pair of nub-holes (not shown) that provide stop points during rotation of the knob 104. In the preferred embodiment, the two stop points are associated with the partial cut mode and the full cut mode.

Figure 2:
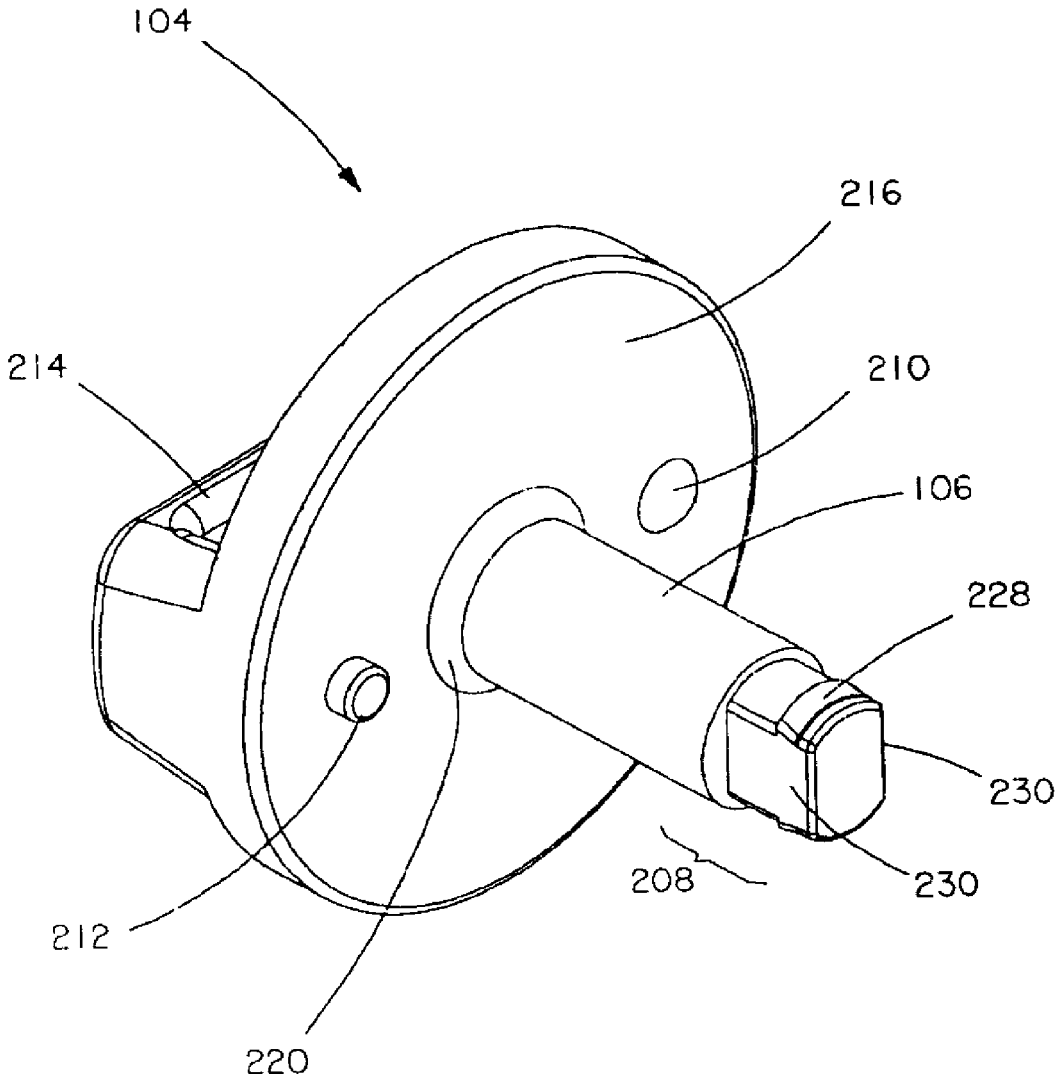
FIG. 2 is a perspective view of the partial cut selector knob of FIG. 1.

The slot 134 and nub-holes of the recess 116 are configured to accept a post and nub of the knob 104. FIG. 2 is useful for showing the knob 104 in more detail. The axial projection 106 of the knob 104 protrudes from a first surface 216. An attachment point 208 at an end of the axial projection 106 is configured to fit snugly within an aperture of the retainer plate 108. The attachment point 208 includes a one-way lip 228 for securing the retainer plate 108 to the attachment point 208 and at least one flat side 230 for ensuring that the retainer plate 108 rotates with the knob 104 as the knob 104 is turned about the axial projection. As understood by those skilled in the art, other elements may be used to secure the retainer plate 108 to the attachment point 208. For instance, washers, clips, and/or nuts may be used to secure the retainer plate 108. In an exemplary embodiment, the axial projection 106 includes a flange 220 near the first surface 216. The flange 220 may be useful for symmetrically securing the knob 104 against the recess 116. The flange 220 may also provide strength to the axial projection 106 and to the connection between the axial projection and a body of the knob 104.

Rotation of the knob 104 is limited by a post 212 that fits in the slot 134. The post 212 protrudes from the first surface 216 and may be substantially cylindrical or may be formed in another shape. A handle 214 is configured for a user to manually rotate the knob 104. Preferably, the handle 214 allows a user to rotate the knob 104 using two or three fingers. However, in other embodiments, a tool or motor may be used for the rotation.

During knob 104 rotation, the post 212 may travel within the slot 134 until it reaches an end of the slot 134. Upon reaching the end of the slot 134, the selector knob 104 is restricted from being rotated any further in the direction of travel. Thus, a user may rotate the knob 104 only within the constraints set by the slot 134. A nub 210 protrudes from the first surface 216 and may have a curved or semi-circular form. The nub 210 is configured to fit in the nub-holes of the recess 116. The nub/nub-hole combination serves to hold the knob 104 in its various positions, such as the partial cut and full cut positions. Each nub-hole may therefore define a distinct selection setting for the cutting profile selector 102. Other or additional selections may be used. For instance, various degrees of partial cut may be provided through intermediate nub-holes.

In the preferred embodiment, the nub 210 and post 212 along with the entire knob 104 are constructed of a plastic. However, other materials are available. For instance, the nub 210 and/or post 212 may be constructed of a metal. Further, the nub 210 may be a ball bearing partially embedded in the first surface 216.

The spring 110 is disposed about the axial projection 106, between the retainer plate 108 and a back-side of the recess 116. The spring 110 is in a compressed state and thus, applies a force against both the retainer plate 108 and the back-side of the recess 116. This force is mechanically transferred at the attachment point 208 to the axial projection 106 and the knob 104. The transferred force, in turn, biases the first surface 216 of the knob 104 against a front-side of the recess 116. The force applied by the spring 110 further helps ensure that the post 212 remains constrained by the slot 134 and that the nub 210 is secured within the nub-holes.

Returning now to FIG. 1, a moving blade 120 is mounted to the cutter button 112 and displaced from the cutter button 112 by a pair of blade springs 122. The moving blade 120 has a cutting edge 124 in which a notch 126 is formed. The moving blade 120 may be made from any appropriate material. In one embodiment, the moving blade may be constructed of hardened steel, such as a tool steel.

A pair of button springs 128 bias the cutter button 112 away from the cutter frame 114. The cutter frame 114 includes a pair of projections 130 or bosses, and a stationary blade 132. As suggested above, the stationary blade 132 may be formed from any appropriate material, such as a tool steel.

The operation of the material cutter 100 shown in FIG. 1 will now be described with reference to FIGS. 3 and 4, which show the material cutter 100 in assembled form. In general, when the material cutter 100 is assembled, the cutter button 112 is slidably disposed within the cutter frame 114 so that the moving blade 120 can be moved, against the resistance of the button springs 128, into an overlapping relationship with the stationary blade 132. The extent of overlap between the moving blade 120 and the stationary blade 132 is controlled in this embodiment by the position of the cutting profile selector 102. In operation, a driving force on the cutter button 112 moves the movable blade 120 toward the stationary blade 132. When the driving force on the cutter button 112 is removed, the button springs 128 urge the cutter button 112 back to its starting position.

Figure 3:
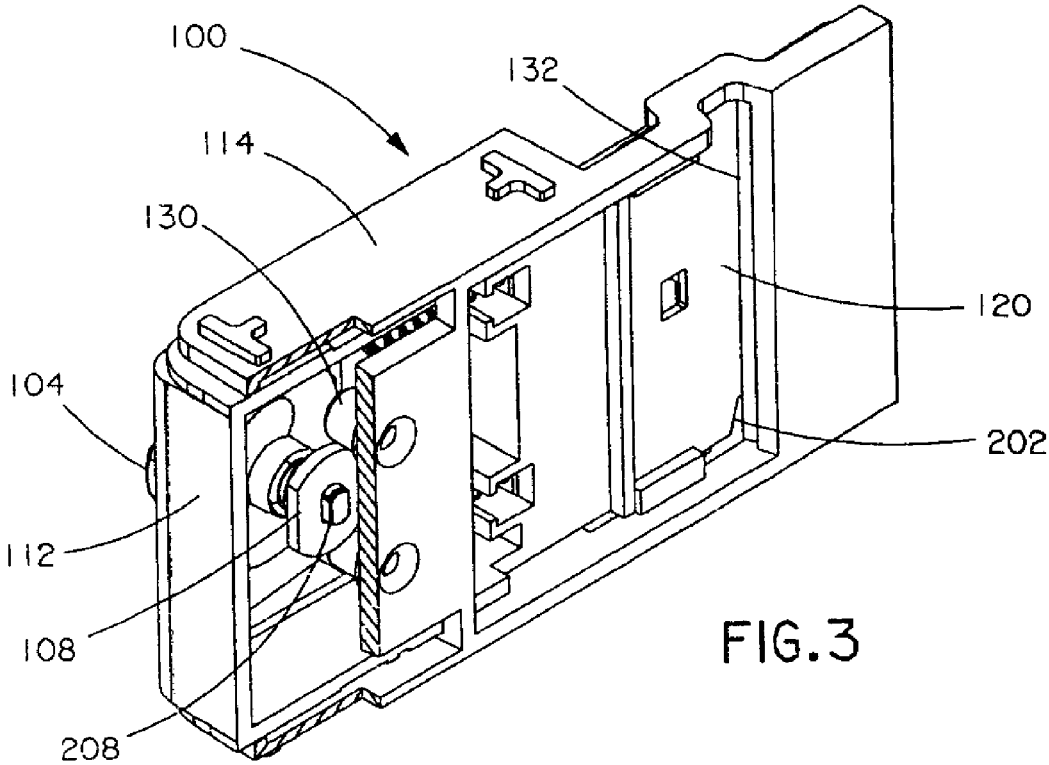
FIG. 3 is a perspective view of a back side of the material cutter of FIG. 1, where the cutting profile selector has been moved to a partial cut position.

FIG. 3 is a perspective view of a back side of the material cutter 100 of FIG. 1, where the cutting profile selector 102 has been moved to a partial cut position. As shown in FIGS. 1, 3 and 4, the asymmetric retainer plate 108 is attached to the attachment point 208 of the knob 104, so that the retainer plate 108 rotates as the selector knob 104 rotates. To make a cut, the cutter button 112 slides within the cutter frame 114 (from left-to-right in FIG. 3) to drive the moving blade 120 across the stationary blade 132.

With the cutting profile selector 102 in the partial cut position, the bosses 130 of the cutter frame 114 eventually interfere with the linear motion of the asymmetric retainer plate 108 as the cutter button 112 slides within the cutter frame 114, preventing the cutting edge 124 of the moving blade 120 from entirely passing the stationary blade 132. In particular, as shown in FIG. 3, when the retainer plate 108 strikes the bosses 130, a partial cut opening 202 appears between the moving blade 120 and the stationary blade 132. In this manner, material passing between the moving blade 120 and the stationary blade 132 would be only partially cut.

The height of the uncut portion of the material is determined, in accordance with a preferred embodiment, by the dimensions of the notch 126 in the moving blade 120. It is not necessary, however, that the moving blade 120 include the notch 126. To the contrary, various cutting profiles may be implemented using a moving blade 120 without a notch. Nonetheless, the notch 126 provides advantages such as allowing more tolerance for the location of the bosses 130, for instance. In FIG. 3, a portion of the back-side of the cutter frame 114 has been cut away, as illustrated by the hashing, to show how the bosses 130 and retainer plate 108 interact to limit the travel of the cutter button 112.

Figure 4:
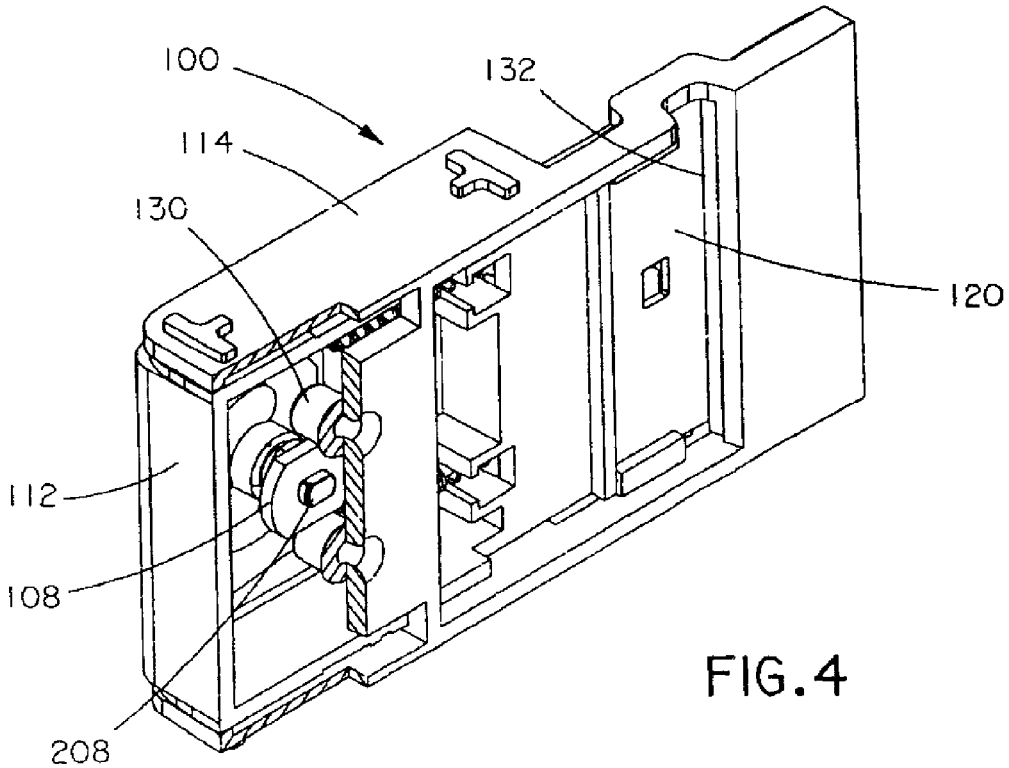
FIG. 4 is a perspective view of the back side of the material cutter of FIG. 1, where the cutting profile selector has been moved to a full cut position.

FIG. 4 is a perspective view of the back side of the material cutter 100 of FIG. 1, where the cutting profile selector 102 has been moved to a full cut position. In this example, movement of the cutting profile selector 102 to the full cut position causes the retainer plate 108 to rotate so that it may now pass between the bosses 130. Because the bosses 130 no longer interfere with the linear motion of the asymmetric retainer plate 108 as the cutter button 112 slides within the cutter frame 114, the moving blade 120 passes entirely over the stationary blade 132. In this manner, material passing between the moving blade 120 and the stationary blade 132 will be completely severed. As in FIG. 3, in FIG. 4, a portion of the back side of the cutter frame 114 has again been cut away, as illustrated by the hashing, to show how the bosses 130 no longer interfere with the retainer plate 108 and do not limit the travel of the cutter button 112.

In accordance with a preferred embodiment, the material cutter 100 is a manual cutter. In other words, a user selects the cutting profile by manually rotating the selector knob 104 and separately causes the cutter button 112 to slide in the cutter frame 114 by applying a driving force to the cutter button 112. Of course, either or both of these functions may be automated. For example, the cutting profile may be automatically selected as a parameter for a particular print job. In other words, one type of cutting profile, for example partial cut profile, may be automatically applied to certain types of print jobs. A controller may, for instance, determine the cut profile based on the size of the job or the logical relationship among the printed material. One such logical relationship may relate to sequentially labeling the wires in an electrical cabinet. Another type of cutting profile, for example, a full cut profile, may be automatically applied to other types of print jobs. The controller may further automatically control the driving force applied on the cutter button 112. For instance, the cutter button 112 may be automatically driven through the cutter frame 114 using timing information for the drive being supplied by the controller, a microprocessor or similar device. Those skilled in the art would be readily capable of devising a number of suitable alternative drive mechanisms for this purpose.

The cutting profile selector 102 may take alternative forms, including other mechanical or electro-mechanical forms, such as a switch. For example, where the material cutter 100 is incorporated into a label printer, a switch, whose position is electronically monitored by a processor or controller, may be used to indicate a user's selected cutting profile. As a further example, the printer may include a display and/or a keyboard, and the user may depress one or more keys to select a cutting profile or the display may provide instructions to the user on the selection of a cutting profile. Of course, in these alternative embodiments, the material cutter 100 would be modified to adjust to the appropriate cutting profile in response to the user input. For example, instead of providing the retainer plate 108 attached to the selector knob 104, the retainer plate 108 may be rotatably mounted to a different structural member, with the position of the retainer plate 108 depending on the user input. Other mechanisms, with or without the retainer plate 108, may alternatively be used.

Figure 5:
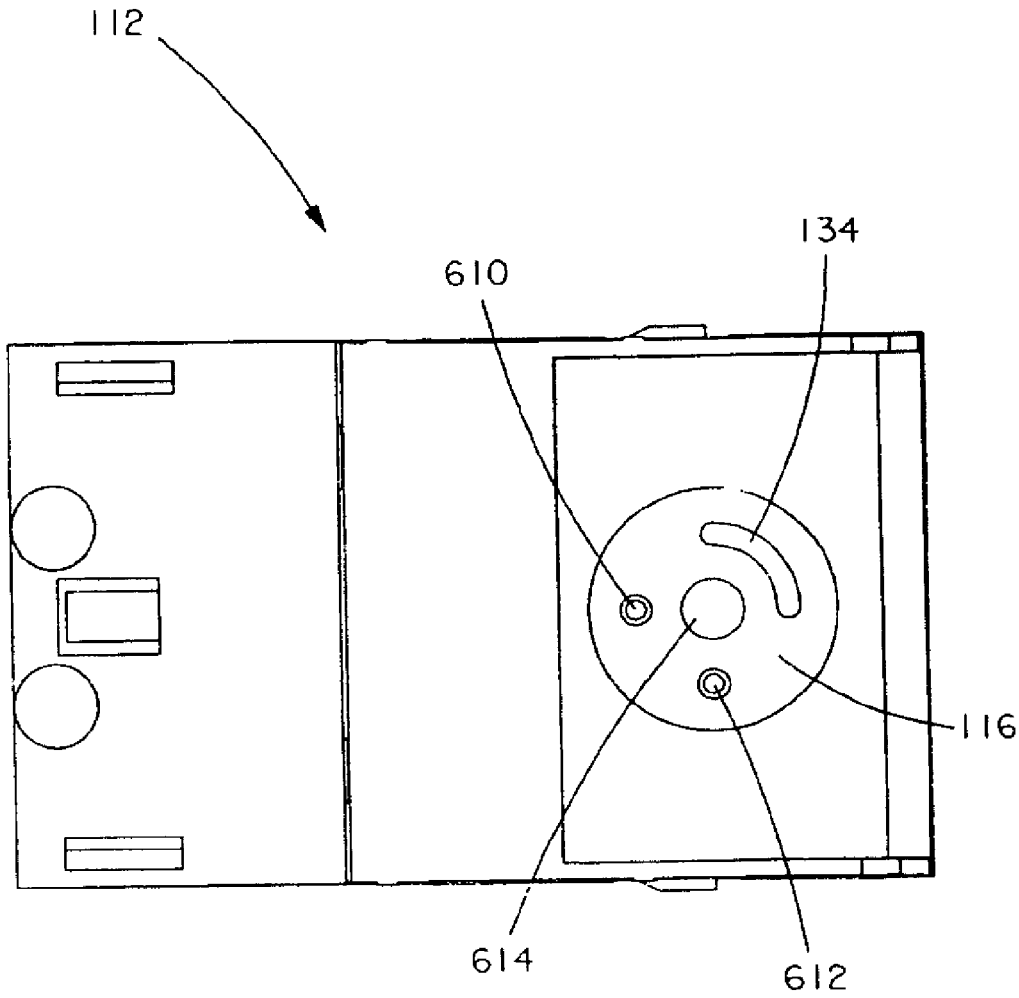
FIG. 5 is a plane view of a front side of a cuter button.

FIG. 5 provides a planar view of a front side of the cutter button 112, and is useful for showing the attachment area for the knob 104 in a preferred embodiment. In the embodiment, a circular inset forms a recess 116. The recess 116 includes a slot 134, a first nub-hole 610, and a second nub-hole 612.

According to the embodiment, the slot 134 is formed as an arc spanning approximately 90 degrees from end-to-end. In other embodiments, the slot 134 may span a larger or smaller angle, depending upon the configuration. In one embodiment, the slot 134 is an aperture that passes through the cutter button material. Alternatively, the slot 134 is a groove or notch in the surface of the cutter button material. In that case, the slot 134 may be configured to have a depth that is at least as great as a protrusion depth of the post 212.

In an exemplary embodiment, the first and second nub-holes 610, 612 are formed as concave circular notches in the surface of the recess 116. Alternatively, the nub holes 610, 612 may be holes that pass completely through the surface of the recess 116.

During construction it may be beneficial to coordinate the design of the nub 210 with the design of the nub-holes 610, 612. Preferably, when the knob 104 is rotated to align the nub 210 with one of the nub-holes, the force created by the spring 110 will pull the nub 210 into the associated hole. Once the nub 210 is in a nub-hole, the knob 104 is said to be at a "stop point." A larger rotation force is then required to rotate the knob 104.

According to the preferred embodiment, the recess 116 is useful for providing a lower profile assembly and for more securely holding the knob 104 in place. If used in a hand-held printer, for instance, the low profile may be more important—as product size and durability are major considerations. Further, the low profile may allow the knob 104 to slide under a housing of the printer during the cutting process. In an alternative embodiment, the recess 116 may be a surface on-level with the adjacent cutter button surface. Another embodiment places the knob/button attachment point on a raised area.

Figure 6:
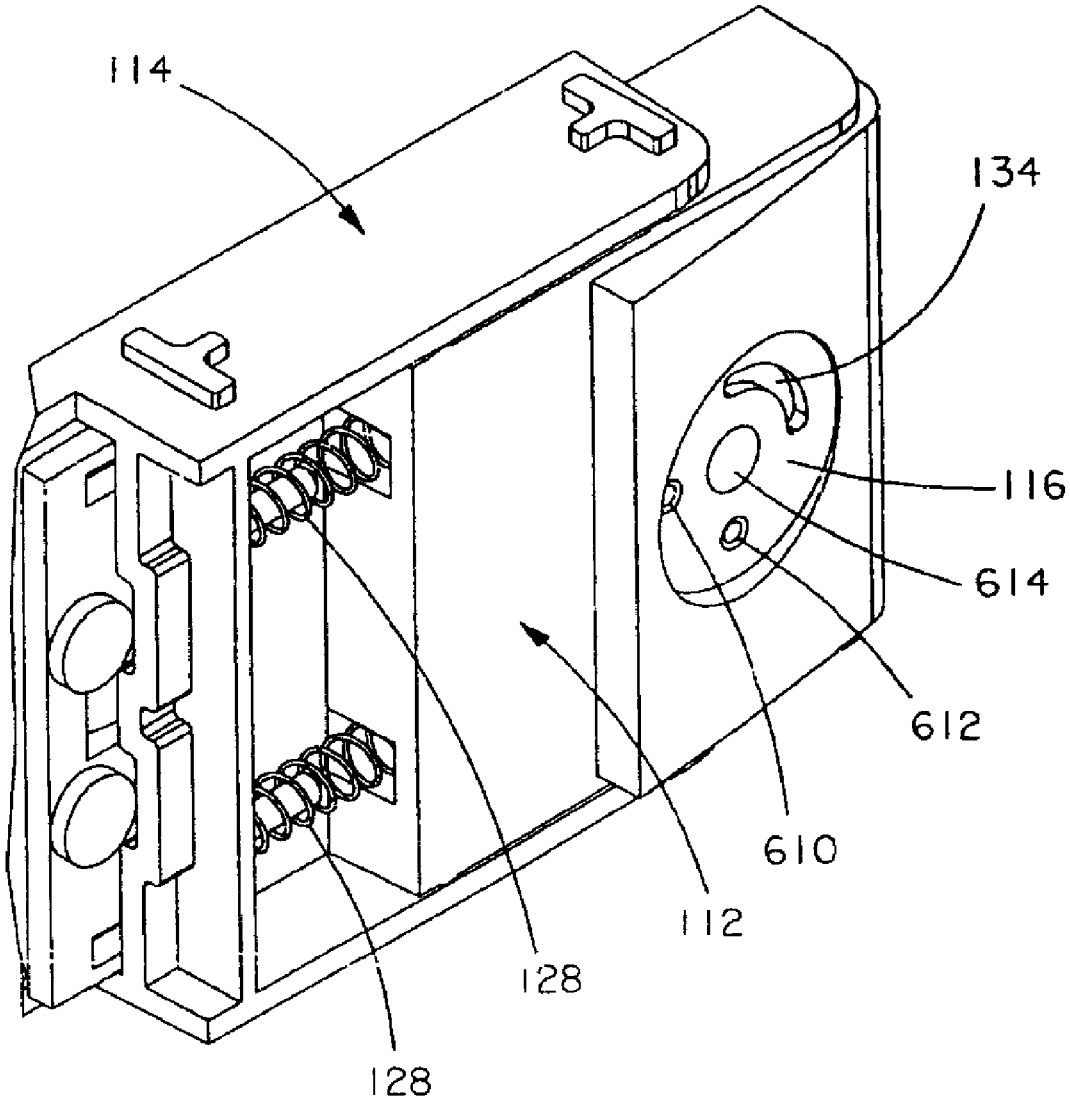
FIG. 6 is a perspective view of the front side of the cutter button of claim 5.

FIG. 6 is a perspective view of the cutter button assembly. The cutter button 112 is shown partially inserted into the cutter frame 114. Button springs 128 provide a force to keep the button 112 in an open position. An opposing force (right-to-left) applied by a user may compress the button springs 128 and cause the moving blade to slide against the stationary blade. The cutter button 112 includes the recess 116 having a slot 134, and at least two nub-holes 610, 612.

Figure 7A:
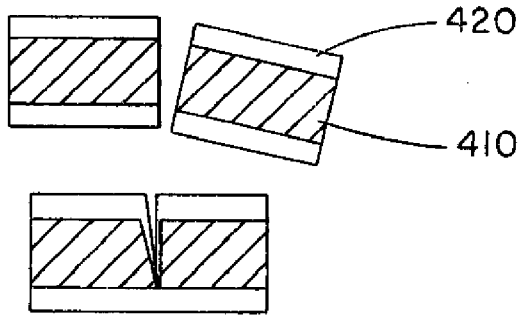
FIGS. 7A through 7C illustrate label media that has been fully cut and partially cut, for example by the material cutter of FIG. 1.
Figure 7B:
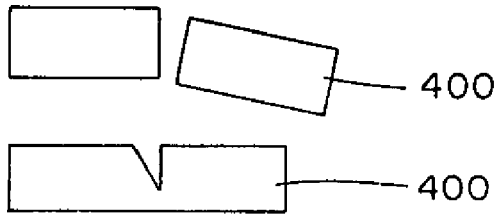
Figure 7C:
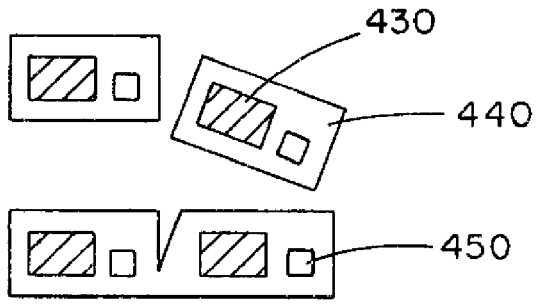

FIGS. 7A through 7C illustrate examples of label media 400 that has been fully cut and partially cut, for example by the material cutter 100 of FIG. 1. In FIG. 7A, the label media 400 is a continuous label material 410 that is carried on a liner 420. The continuous label material 410 may be, for example, a self-adhesive material, which can be removed from the liner 420 when the labels are applied. Other types of continuous label material may alternatively be used. As shown in FIG. 7A, a selectable cutting profile, in this case a full cut (top illustration) and a partial cut (bottom illustration), may be applied to the label media 400 to produce a series of labels from the continuous label material 410. In partial cut mode for the continuous label material 410 on the liner 420, the material cutter 100 preferably cuts all the way or substantially through the continuous label material 410. Because the continuous label material 410 is, in this example, vertically centered on the liner 420, the partial cut mode produces individual labels that are cleanly cut, while the liner 420 holds the labels together in the order that they are printed.

In the example of FIG. 7B, the label media 400 is a heat shrink label material. As shown, the material cutter 100 may apply a selected cutting profile to the heat shrink label material. In this example, the cutting profiles are a full cut (top illustration) and a partial cut (bottom illustration).

In the example of FIG. 7C, the label media 400 is a series of die-cut labels 430 on a liner 440. The liner 440 includes registration slots 450, which may be used by a printer to locate the die-cut labels 430 so that the printed matter starts in the proper place on the die-cut labels 430. The die-cut labels 430 may be, for example, self-adhesive labels, which can be removed from the liner 440 when the labels are applied. Other types of die-cut labels may alternatively be used. As shown in FIG. 7C, the material cutter 100 may apply a selected cutting profile to the die-cut labels 430 and liner 440. In this example, the cutting profiles are a full cut (top illustration) and a partial cut (bottom illustration), and the cuts are located in the liner 440 between die-cut labels 430.

Of course, other types of label media 400 and cutting profiles may alternatively be used. The preferred embodiments are not limited to any particular label media 400 or any particular type of label media 400. To the contrary, the material cutter 100 described herein is suitable for a wide variety of cutting applications.

II. Printer with Material Cutter

Figure 8:
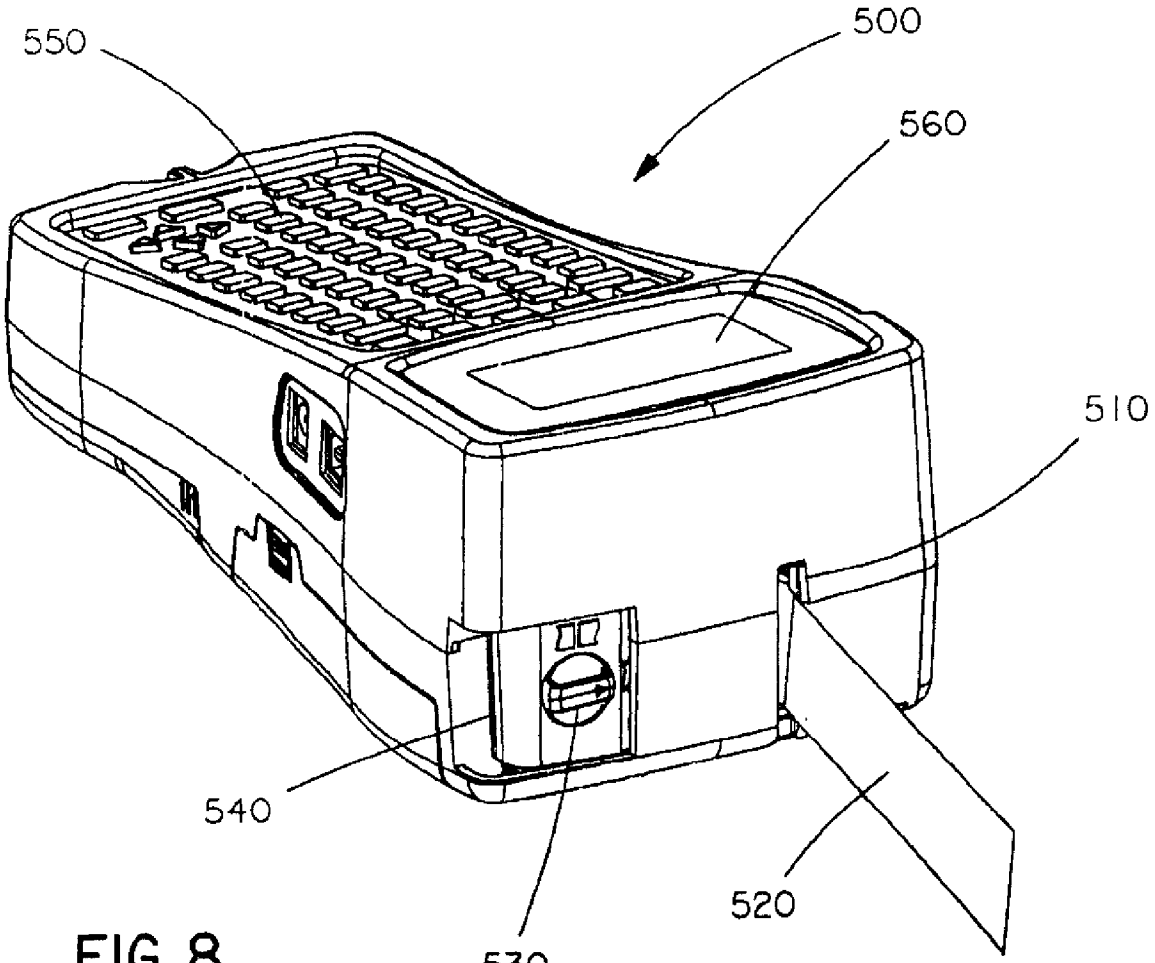
FIG. 8 is a perspective view of a hand-held printer incorporating the material cutter of FIG. 1.

FIG. 8 is a perspective view of a hand-held printer 500 incorporating the material cutter 100 of FIG. 1. The hand-held printer 500 has a slot 510 through which label media 520 exits the hand-held printer 500. At the same end of the hand-held printer 500 as the slot 510, the hand-held printer 500 includes a selector knob 530 that is mounted in a cutter button 540.

The material cutter 100 shown in FIG. 8 is a manual device. To cut the label media 520, the user slides the cutter button 540 laterally toward the slot 510 (left-to-right). As described above with reference to FIGS. 1-4, the selector knob 530 may be used to select a cutting profile. For example, the selector knob 530 may be positioned for a partial cut cutting profile or a full cut cutting profile. Again, other or additional cutting profiles may alternatively be used, including a variety of partial cut cutting profiles. Then, to make a cut having the selected profile, the user slides the cutter button 540 toward the slot 510 and the label media 520. As described above, the material cuter 100 may include a mechanism, such as the button springs 128, to return the cutter button 540 to its starting position when the user releases the cutter button 540.

Although described as a manual material cutter 100 in referring to FIG. 8, of course the material cutter 100 may alternatively be automated in at least two aspects. First, as described above, the cutting profile may be automatically selected as a parameter for a particular print job. Second, the cutter button 540 may be automatically driven toward the slot 510, with, for example, timing information for the drive being supplied by a microprocessor, controller or similar device. As shown in FIG. 8, the printer 500 includes a keyboard 550 and a display 560. The keyboard 550 and the display 560 may facilitate the automated operation of the printer 500.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the spirit and scope of the present invention. Although specific terms are employed herein, they are used in a generic and descriptive sense only and not for purposes of limitation.

The invention claimed is:

1. A material cutter comprising:

a cutter frame having a stationary blade; and a cutter button slidably disposed within the cutter frame, the cutter button having a moving blade with a cutting edge and a selector knob rotatably secured to the cutter button for selecting a cutting profile, wherein the selector knob having an axial projection with an attachment point at a distal end; the cutter button further comprising a retainer plate positioned on the attachment point, whereby rotation of the selector knob rotates an orientation of the retainer plate.

2. The material cutter of claim 1, wherein the cutter button includes a recess for receiving the selector knob, the recess having a slot and the selector knob having a post, whereby the post of the selector knob is disposed in the slot of the recess for restricting the rotation of the selector knob.

3. The material cutter of claim 2, wherein the recess and the selector knob further comprise a means for holding the selector knob in various positions corresponding to the cutting profile.

4. The material cutter of claim 1, wherein the cutting profile includes one of a full cut mode and a partial cut mode.

5. The material cutter of claim 1, wherein the retainer plate having opposed flat sides and opposed curved sides.

6. The material cutter of claim 1, wherein the selector knob is rotated to a partial cut mode, whereby bosses extending from the cutter frame engage the retainer plate to restrict the movement of the cutter button and the moving blade from passing the stationary blade of the cutter frame.

7. The material cutter of claim 1, wherein the selector knob is rotated to a full cut mode, whereby the cutter button freely slides the moving blade past the stationary blade of the cutter frame.

* * * * *